US011460281B2

(12) United States Patent
LeClair et al.

(10) Patent No.: US 11,460,281 B2
(45) Date of Patent: Oct. 4, 2022

(54) DETONATION INTERRUPT DEVICE

(71) Applicant: Halliburton Energy Services, Inc., Houston, TX (US)

(72) Inventors: Nicholas Peter LeClair, Mansfield, TX (US); Cameron Scott Badii, Fort Worth, TX (US); Jason Cook, Crowley, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/017,156

(22) Filed: Sep. 10, 2020

(65) Prior Publication Data

US 2022/0074723 A1 Mar. 10, 2022

(51) Int. Cl.
*F42C 15/34* (2006.01)
*E21B 43/1185* (2006.01)
*F42D 5/00* (2006.01)

(52) U.S. Cl.
CPC ..... *F42C 15/34* (2013.01); *E21B 43/1185* (2013.01); *F42D 5/00* (2013.01)

(58) Field of Classification Search
USPC ..... 102/221
See application file for complete search history.

(56) References Cited

U.S. PATENT DOCUMENTS 4,292,895 A * 10/1981 Bell ..... E21B 43/117 102/254
4,314,614 A * 2/1982 McPhee ..... E21B 43/1185 102/260
4,561,356 A * 12/1985 Bordon ..... E21B 43/117 102/202.1
5,027,708 A 7/1991 Gonzalez et al.
8,042,471 B2 10/2011 Michel et al.
8,408,134 B2 * 4/2013 Sibum ..... F42C 15/188 102/255
9,903,695 B1 2/2018 Goodman et al.
2007/0267195 A1 11/2007 Grigar et al.
(Continued)

FOREIGN PATENT DOCUMENTS

EP 1930541 A2 6/2008
WO 2015123436 A1 8/2015

*Primary Examiner* — Reginald S Tillman, Jr.
(74) *Attorney, Agent, or Firm* — John Wustenberg; Parker Justiss, P.C.

(57) ABSTRACT

Provided is a detonation interrupt device. The detonation interrupt device, in one aspect, includes a first detonation train member positioned within a housing, and a mechanical member positioned proximate the first detonation train member. In this aspect, the mechanical member is movable between a first position physically separating the first detonation train member from a second detonation train member and thereby preventing the first detonation train member from detonating the second detonation train member, and a second position not physically separating the first detonation train member from the second detonation train member and thereby allowing the first detonation train member to detonate the second detonation train member, wherein the mechanical member is configured to automatically move from the first position to the second position as the housing and the second detonation train member move linearly with respect to each other.

18 Claims, 9 Drawing Sheets

(56) References Cited

U.S. PATENT DOCUMENTS

| | | | | |
|---|---|---|---|---|
| 2010/0147176 | A1* | 6/2010 | Alculumbre | F42C 15/24 102/256 |
| 2014/0231065 | A1 | 8/2014 | Mason et al. | |
| 2015/0292850 | A1* | 10/2015 | Davidson | F42C 15/34 102/206 |

* cited by examiner

DETONATION INTERRUPT DEVICE

BACKGROUND

The shipment of explosives for oil and gas applications is carefully regulated by various government agencies (e.g., the Department of Transportation ("DOT")), primarily for safety purposes. The regulations impose various levels of restrictions depending upon type of explosive, weight of individual explosive components, total weight in an individual package, relative positioning of multiple explosive components in a single package, types of packaging materials and other factors. It is desirable for the explosives used to meet the requirements for the least restrictive shipping rules, both because it reduces the expense and time for shipping, and means that the risk of accidents has been minimized.

BRIEF DESCRIPTION

Reference is now made to the following descriptions taken in conjunction with the accompanying drawings, in which.

DETAILED DESCRIPTION

Figure 1:
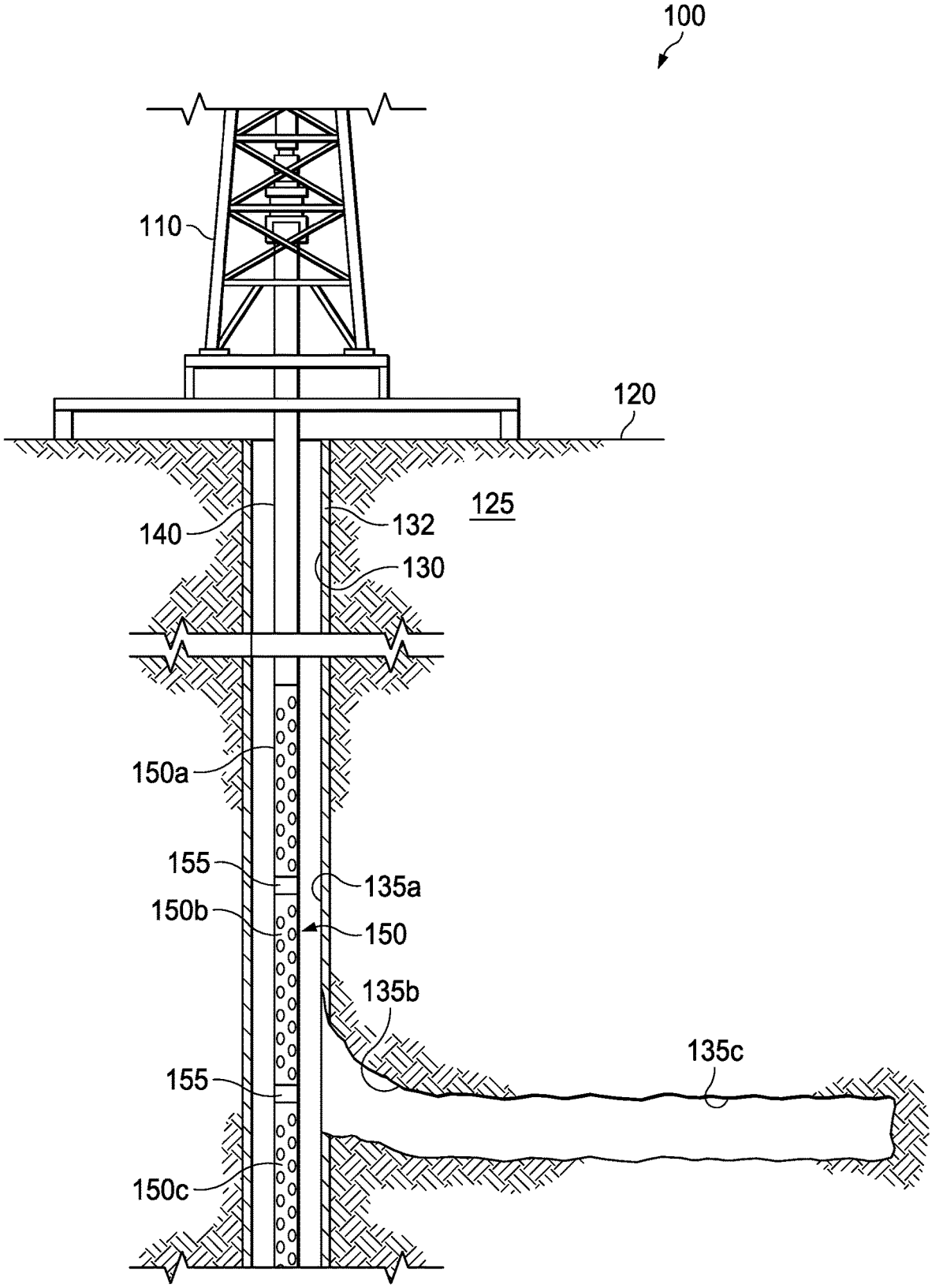
FIG. 1 illustrates a well system designed, manufactured, and operated according to one or more examples of the disclosure.

Specific examples are described in detail and are shown in the drawings, with the understanding that the present disclosure is to be considered an exemplification of the principles of the disclosure, and is not intended to limit the disclosure to that illustrated and described herein. It is to be fully recognized that the different teachings of the examples discussed herein may be employed separately or in any suitable combination to produce desired results.

A detonation interrupt device and method are disclosed for addressing the aforementioned problems associated with the shipment of explosive devices. In one example, the detonation interrupt device includes a mechanical member that physically separates the first detonation train member (e.g., the detonator in one embodiment) from the second detonation train member (e.g., the detonation cord, explosives, etc.). The mechanical member, in at least one embodiment, remains physically between the first and second detonation train members until the perforation gun assembly is fully assembled. For example, the act of physically coupling (e.g., attaching by way of one or more threaded members) a detonator assembly with a detonation cord assembly would automatically move the mechanical member out of the detonation path, thereby allowing the first and second detonation train members to work together properly. In another embodiment, the act of physically coupling (e.g., attaching by way of one or more threaded members) two or more perforation gun assemblies together in series would automatically move the mechanical member out of the detonation path, thereby allowing the two or more perforation gun assemblies to work together properly. Thus, in one embodiment it is the making-up of the perforation gun assembly that provides the necessary linear or rotational motion necessary move the mechanical member, and thus to arm the device.

FIG. 1 illustrates a well system 100 designed, manufactured, and operated according to one or more examples of the disclosure. As depicted, the well system 100 includes a workover and/or drilling rig 110 that is positioned above the earth's surface 120 and extends over and around a wellbore 130 that penetrates a subterranean formation 125 for the purpose of recovering hydrocarbons. The subterranean formation 125 may be located below exposed earth, as shown, as well as areas below earth covered by water, such as ocean or fresh water.

The wellbore 130 may be drilled into the subterranean formation 125 using any suitable drilling technique. In the example illustrated in FIG. 1, the wellbore 130 extends substantially vertically away from the earth's surface 120 over a vertical wellbore portion 135*a*, deviates from vertical relative to the earth's surface 120 over a deviated wellbore portion 135*b*, and transitions to a horizontal wellbore portion 135*c*. In alternative operating environments, all or portions of a wellbore may be vertical, deviated at any suitable angle, horizontal, and/or curved. The wellbore 130 may be a new wellbore, an existing wellbore, a straight wellbore, an extended reach wellbore, a sidetracked wellbore, a multi-lateral wellbore, or any other type of wellbores for drilling and completing one or more production zones. Further, the wellbore 130 may be used for both producing wells and injection wells. In one or more examples, the wellbore 130 comprises wellbore casing 132, which may be cemented into place in the wellbore 130.

A wellbore conveyance 140 may be lowered into the wellbore 130 for a variety of drilling, completion, workover, treatment, and/or production processes, amongst others, throughout the life of the wellbore 130. The example shown in FIG. 1 illustrates the wellbore conveyance 140 in the form of a completion assembly string disposed in the wellbore 130. It should be understood that the wellbore conveyance 140 is equally applicable to any type of wellbore conveyance being inserted into a wellbore 130, including as non-limiting examples drill pipe, casing, liners, jointed tubing, coiled tubing, wireline, slickline, etc. Further, the wellbore conveyance 140 may operate in any of the wellbore orientations (e.g., vertical, deviated, horizontal, and/or curved) and/or types described herein.

Coupled to the wellbore conveyance 140, in the example illustrated in FIG. 1, is a perforating gun assembly 150 designed, manufactured and/or operated according to one or more examples of the disclosure. The perforating gun assembly 150 illustrated in FIG. 1 includes a first gun set 150*a*, a second gun set 150*b*, and a third gun set 150*c*, for example coupled to each other using one or more gun connector housings 155. In accordance with one or more embodiments of the disclosure, the perforating gun assembly 150, whether it be the first, second or third gun sets 150*a*, 150*b*, 150*c*, includes a detonation interrupt device as shown in subsequent figures discussed in further detail below.

Figure 2:
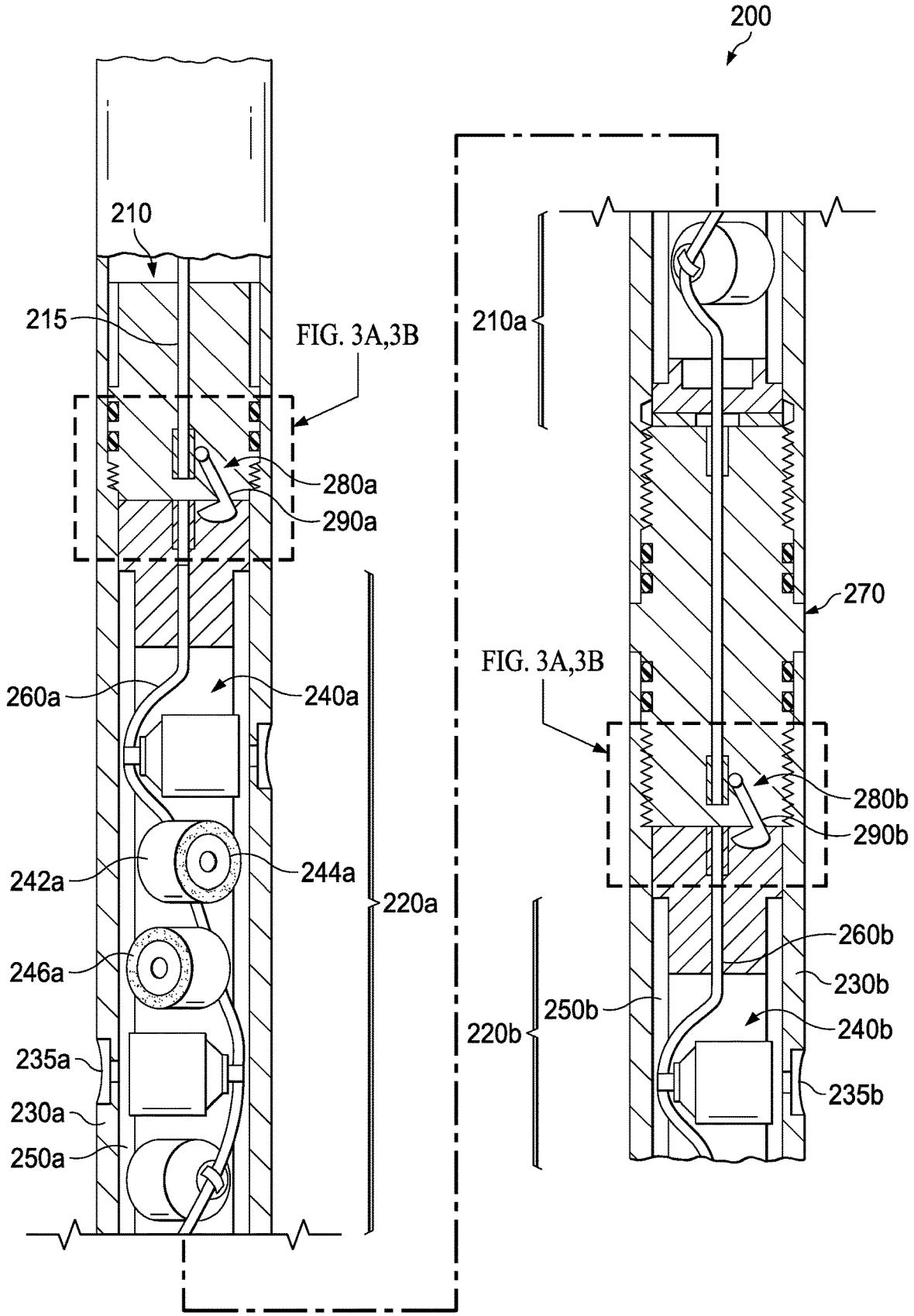
FIG. 2 is a cutaway view of a perforating gun assembly that is designed, manufactured, and/or operated according to one or more aspects of the disclosure.

FIG. 2 is a cutaway view of a perforating gun assembly 200 that may be designed, manufactured, and/or operated according to one or more aspects of the disclosure. The perforating gun assembly 200 may form at least a portion of the perforating gun assembly 150 illustrated in FIG. 1. The perforating gun assembly 200, in accordance with one or more embodiments of the disclosure, may include a detonator alignment housing 210. The detonator alignment housing 210, in the illustrated embodiment, includes a detonator 215 (e.g., a detonation train member) positioned proximate a downhole end thereof. As those skilled in the art appreciate, the detonator 215 is configured to initiate a detonation train within the perforating gun assembly 200.

The perforating gun assembly 200, in accordance with one or more embodiments of the disclosure, additionally includes a first gun set 220*a* and a second gun set 220*b* coupled to the detonator alignment housing 210. In one embodiment, the first gun set 220*a* is threadingly engaged with the detonator alignment housing 210, and the first and second gun sets 220*a*. 220*b* are coupled to one another using a gun connector housing 270. While two gun sets 220*a*, 220*b* are employed in the example of FIG. 2, other examples may exist wherein more or less than two gun sets 220*a*, 220*b* are employed.

In the illustrated embodiment, the first gun set 220*a* includes an uphole carrier gun body 230*a*, which in one example may comprise a cylindrical sleeve having a plurality of recesses 235*a*. Radially aligned with each of the recesses 235*a* is a respective one of a first one or more ballistic elements 240*a*, only six of which are visible within the first gun set 220*a* of FIG. 2. The term ballistic element, as used herein, may include shaped charges, linear charges, propellants, etc., without limitation. While six ballistic elements 240*a* are employed in the example of FIG. 2, other examples may exist wherein more or less than six ballistic elements 240*a* are employed. Each of the first one or more ballistic elements 240*a* may include a housing 242*a*, for example including a housing exterior and a housing interior. Each of the first one or more ballistic elements 240*a* may further include a liner 244*a* positioned within the case interior of the housing 242*a*. Furthermore, explosive material 246*a* may be disposed between the case interior of the housing 242*a* and the liner 244*a* in the example of FIG. 2.

The first one or more ballistic elements 240*a*, in the example shown, are retained within the uphole carrier gun body 230*a* by a charge tube 250*a*. In certain examples, the charge tube 250*a* supports a discharge end of the first one or more ballistic elements 240*a*, wherein an additional inner charge tube (not shown) supports an initiation end of the first one or more ballistic elements 240*a*.

In the example of FIG. 2, each of the first one or more ballistic elements 240*a* (e.g., when assembled) are longitudinally and radially aligned with one of the recesses 235*a* in the uphole carrier gun body 230*a*. In the illustrated example, the first one or more ballistic elements 240*a* are arranged in a spiral pattern such that each ballistic element 240*a* is disposed on its own level or height and is to be individually detonated so that only one ballistic element 240*a* is fired at a time. It should be understood, however, that alternate arrangements for the first one or more ballistic elements 240*a* may be used, including cluster type designs wherein more than one ballistic element 240*a* is at the same level and/or is detonated at the same time.

The first gun set 220*a* further includes an uphole detonation cord 260*a* (e.g., another detonation train member) extending through the uphole carrier gun body 230*a*, and in this embodiment through the gun connector housing 270. In the illustrated embodiment, the uphole end of the uphole detonation cord 260*a* substantially aligns with the downhole end of the detonator 215. Accordingly, the detonator 215 may start a detonation train in the uphole detonation cord 260*a*, which may then be used to detonate ones of the first one or more ballistic elements 240*a*. In the illustrated example, initiation ends of the first one or more ballistic elements 240*a* extend across the central longitudinal axis of the perforating gun assembly 200, allowing the uphole detonation cord 260*a* to connect to the explosive material, for example through an aperture defined at an apex of the housings 242*a*.

The second gun set 220*b* may include many of the same features as the first gun set 220*a*. For example, the second gun set 220*b* includes a downhole carrier gun body 230*b*, as well as a second one or more ballistic elements 240*b* retained within a second charge tube 250*b*. Each of the second one or more ballistic elements 240*b* may comprise similar components as each of the first one or more ballistic elements 240*a*.

The second gun set 220*b* may further include a downhole detonation cord 260*b* (e.g., another detonation train member) extending through the downhole carrier gun body 230*b*. In the illustrated embodiment, the uphole end of the downhole detonation cord 260*b* substantially aligns with the downhole end of the uphole detonation cord 260*a* (e.g., via the gun connector housing 270). Accordingly, the detonator 215 may start a detonation train in the uphole detonation cord 260*a*, which may then be used to detonate ones of the first one or more ballistic elements 240*a*, and then transfer the detonation train to the downhole detonation cord 260*b*, which may then be used to detonate ones of the second one or more ballistic elements 240*b*.

In the embodiment of FIG. 2, separate uphole and downhole detonation cords 260*a*, 260*b* are employed to connect the first and second one or more ballistic elements 240*a*, 240*b*. In such an embodiment, one or more detonation boosters may also be used. Notwithstanding, other embodiments may exist wherein a single detonation cord is employed.

The perforating gun assembly 200, in accordance with one or more embodiments of the disclosure, additionally includes one or more detonation interrupt devices 280. For example, the perforating gun assembly 200 of FIG. 2 includes a first detonation interrupt device 280*a*, and a second detonation interrupt device 280*b*. The first detonation interrupt device 280*a* is configured to selectively interrupt a detonation train from the detonator 215 to the uphole detonation cord 260*a*, whereas the second detonation interrupt device 280*b* is configured to selectively interrupt a detonation train from the uphole detonation cord 260*a* to the downhole detonation cord 260*b*.

In accordance with one embodiment, the first detonation interrupt device 280*a* includes a mechanical member 290*a* positioned proximate the detonator 215, the mechanical member 290*a* movable between a first position physically separating the detonator 215 from the uphole detonation cord 260*a* and thereby preventing the detonator 215 from detonating the uphole detonation cord 260*a*, and a second position not physically separating the detonator 215 from the uphole detonation cord 260*a* and thereby allowing the detonator 215 to detonate the uphole detonation cord 260*a*. In the illustrated embodiment, the mechanical member 290*a* is in the second position, and thus the first gun set 220*a* is armed.

The second detonation interrupt device 280*b* includes a mechanical member 290*b* positioned proximate the downhole end of the uphole detonation cord 260*a*, the mechanical member 290*b* movable between a first position physically separating the uphole detonation cord 260*a* from the downhole detonation cord 260*b* and thereby preventing the uphole detonation cord 260*a* from detonating the downhole detonation cord 260*b*, and a second position not physically separating the uphole detonation cord 260*a* from the downhole detonation cord 260*b* and thereby allowing the uphole detonation cord 260*a* to detonate the downhole detonation cord 260*b*. In the illustrated embodiment, the mechanical member 290*b* is in the second position, and thus the second gun set 220*b* is armed.

Figure 3A:
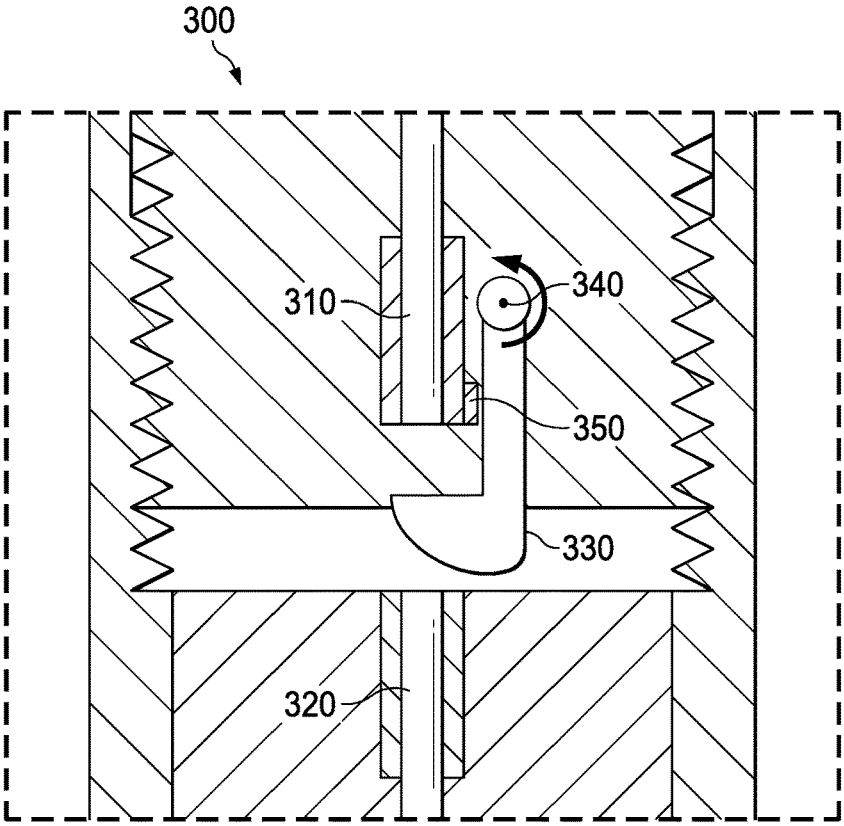
FIGS. 3A and 3B illustrate enlarged views of a detonation interrupt device that is designed, manufactured, and/or operated according to one or more aspects of the disclosure.
Figure 3B:
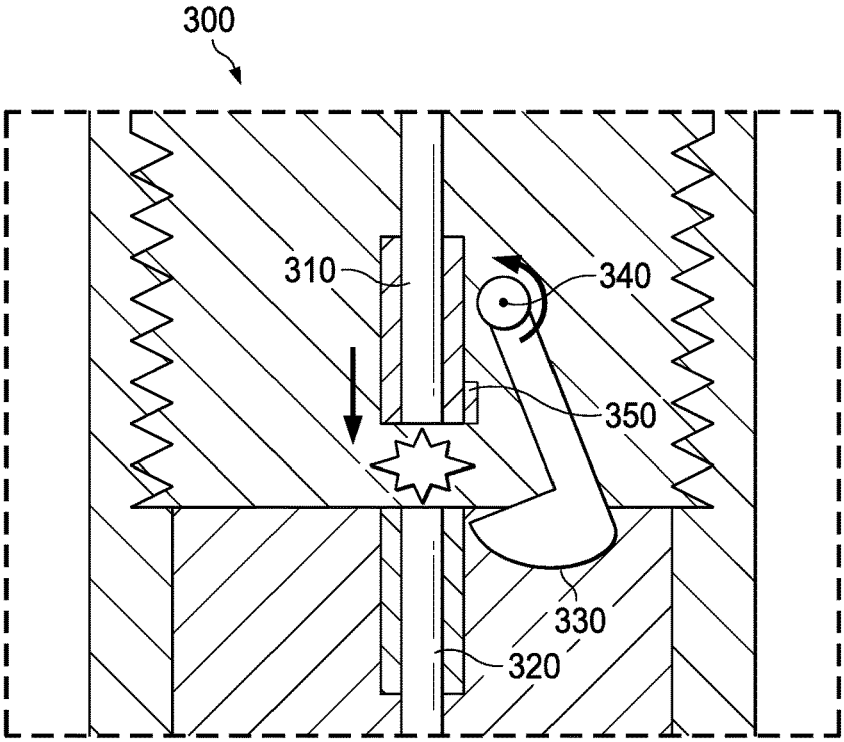

FIGS. 3A and 3B illustrate enlarged views of a detonation interrupt device 300 that is designed, manufactured, and/or operated according to one or more aspects of the disclosure. The detonation interrupt device 300 may, in one embodiment, form at least a portion of the perforating gun assembly 200 illustrated in FIG. 2. In the illustrated embodiment, the uphole side of the detonation interrupt device is on the left side of FIGS. 3A and 3B. Nevertheless, in other embodiments the uphole side of the detonation interrupt device is on the right side of FIGS. 3A and 3B. Furthermore, the detonation train may move from left to right, or alternatively right to left. The detonation interrupt device 300, in the illustrated embodiment, includes a first detonation train member 310 and a second detonation train member 320 spaced apart from one another. While not shown, the first detonation train member 310 may be located within a housing (e.g., detonator alignment housing, carrier gun body, etc.). In one embodiment, the first detonation train member 310 may comprise a detonator (e.g., similar to the detonator 215 in FIG. 2) and the second detonation train member 320 may comprise a detonation cord (e.g., similar to the uphole detonation cord 260*a* illustrated in FIG. 2). In an alternative embodiment, the first detonation train member 310 may comprise a detonation cord (e.g., similar to the uphole detonation cord 260*a* illustrated in FIG. 2) and the second detonation train member 320 may comprise a detonator (e.g., similar to the detonator 215 in FIG. 2). In yet another embodiment, the first detonation train member 310 may comprise a first detonation cord (e.g., similar to the uphole detonation cord 260*a* illustrated in FIG. 2) and the second detonation train member 320 may comprise a second detonation cord (e.g., similar to the downhole detonation cord 260*b* illustrated in FIG. 2). In yet even another alternative embodiment, the first detonation train member 310 may comprise a first detonation cord (e.g., similar to the downhole detonation cord 260*b* illustrated in FIG. 2) and the second detonation train member 320 may comprise a second detonation cord (e.g., similar to the uphole detonation cord 260*a* illustrated in FIG. 2). Accordingly, unless otherwise required, the present disclosure is not limited to any specific types of detonation train members.

The detonation interrupt device 300 illustrated in FIGS. 3A and 3B additionally includes a mechanical member 330 positioned proximate the first detonation train member 310. As is illustrated, the mechanical member 330 is movable between a first position, as shown in FIG. 3A, and a second position, as shown in FIG. 3B. When in the first position, the mechanical member 330 physically separates the first detonation train member 310 from the second detonation train member 320. In this configuration, the mechanical member 330 prevents the first detonation train member 310 from detonating the second detonation train member 320, as the mechanical member 330 physically separates the two. When in the second position, the mechanical member 330 does not physically separate the first detonation train member 310 from the second detonation train member 320. In this second configuration, the mechanical member 330 allows the first detonation train member 310 to detonate the second detonation train member 320, as the mechanical member 330 does not physically separate the two.

In the illustrated embodiment of FIGS. 3A and 3B, the mechanical member 330 automatically moves from the first position to the second position as the housing and the second detonation train member 320 move relative to one another (e.g., the housing linearly moves toward the second detonation train member 320). Further to this embodiment of FIGS. 3A and 3B, the mechanical member 330 automatically moves from the first position to the second position as the housing and the first detonation train member 310 linearly move toward the second detonation train member 320. While the first detonation train member 310 is moving as the housing is moving in the embodiment of FIGS. 3A and 3B, other embodiments may exist wherein one or the other of the housing and first detonation train member 310 do not move relative to the second detonation train member 320.

The mechanical member 330, in the illustrated embodiment, rotates about an axis 340 that is substantially perpendicular to a direction of movement of the housing, as illustrated by the arrow in FIG. 3B. Thus, as the mechanical member 330 approaches the second detonation train member 320, an outer sloped surface of the mechanical member 330 engages with and slides along a surface of the second detonation train member 320, and thereby rotates the mechanical member 330 from the first position to the second position. As shown in FIG. 3B, the movement of the mechanical member 330 from the first position to the second position allows the first detonation train member 310 to be in a position to detonate the second detonation train member 320.

In certain embodiments, a spring member (not shown) keeps the mechanical member 330 in the first position until a force sufficient to overcome the spring constant of the spring member is applied upon the mechanical member 330, wherein the mechanical member 330 is allowed to move to the second position. According to this embodiment, the natural state for the mechanical member 330 is the first position. Therefore, if the detonation interrupt device 300 were to fail, its safety would still be intact.

The detonation interrupt device 300 illustrated in the embodiment of FIGS. 3A and 3B may additionally include an electronic disconnect member 350 associated therewith. For example, the electronic disconnect member 350 may be designed to electrically disarm the first detonation train member 310 when the mechanical member 330 is in the first position and electrically arm the first detonation train member 310 when the mechanical member 330 is in the second position. For example, the electronic disconnect member 350 could be an electric shunt that electrically decouples the first detonation train member 310 from detonation electronics when the mechanical member 330 is in the first position and electrically couples the first detonation train member 310 to the detonation electronics when the mechanical member 330 is in the second position. If the mechanical member 330 were made of a conductive material, the mechanical member 330 could act as the shunt for the electronic disconnect member 350. In the illustrated embodiment, the electronic disconnect member 350 electrically arms the first detonation train member 310 prior to the mechanical member 330 moving entirely from the first position to the second position. In an alternative embodiment, the electronic disconnect member 350 would not arm the first detonation train member 310 until the mechanical member 330 is entirely in the second position.

Figure 4A:
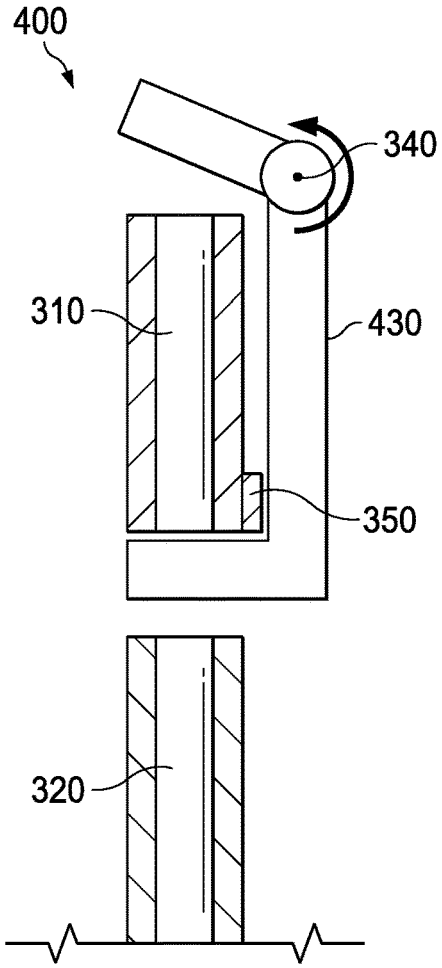
FIGS. 4A and 4B illustrate enlarged views of another detonation interrupt device that is designed, manufactured, and/or operated according to one or more aspects of the disclosure.
Figure 4B:
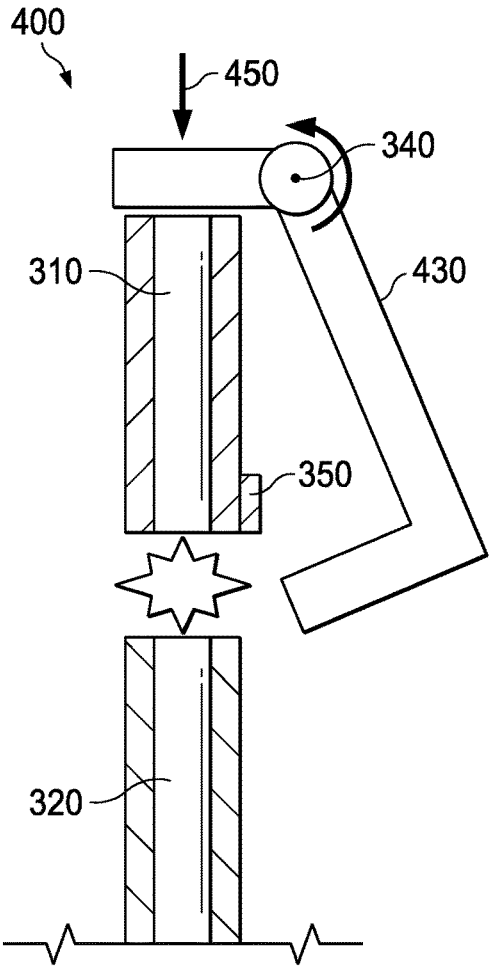

FIGS. 4A and 4B illustrate enlarged views of another detonation interrupt device 400 that is designed, manufactured, and/or operated according to one or more aspects of the disclosure. The detonation interrupt device 400 is similar in many respect to the detonation interrupt device 300 of FIGS. 3A and 3B. Accordingly, like reference numbers have been used to reference similar, if not identical, features. The detonation interrupt device 400 differs, for the most part, from the detonation interrupt device 300, in that the mechanical member 430 is different in shape, and is actuated using a different force that that illustrated in FIGS. 3A and 3B. In the embodiment of FIGS. 4A and 4B, a force 450 applied upon the mechanical member 430 is generated by the movement of the housing, which in turn rotates the mechanical member 430 from the first position to the second position. Furthermore, in the embodiment of FIG. 4A, the first detonation train member 310 and the second detonation train member 320 are linearly fixed relative to one another as the mechanical member 430 rotates from the first position to the second position.

Figure 5A:
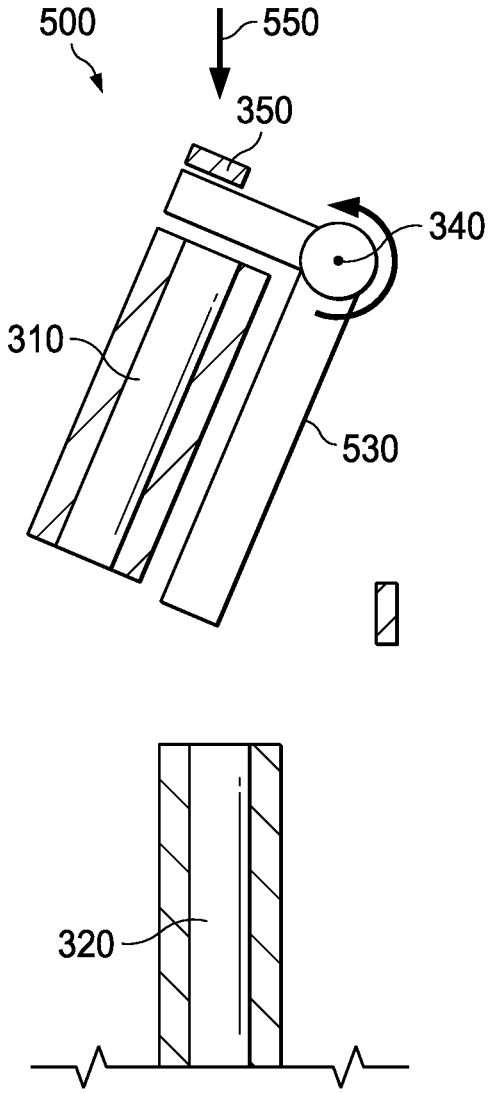
FIGS. 5A and 5B illustrate enlarged views of yet another detonation interrupt device that is designed, manufactured, and/or operated according to one or more aspects of the disclosure.
Figure 5B:
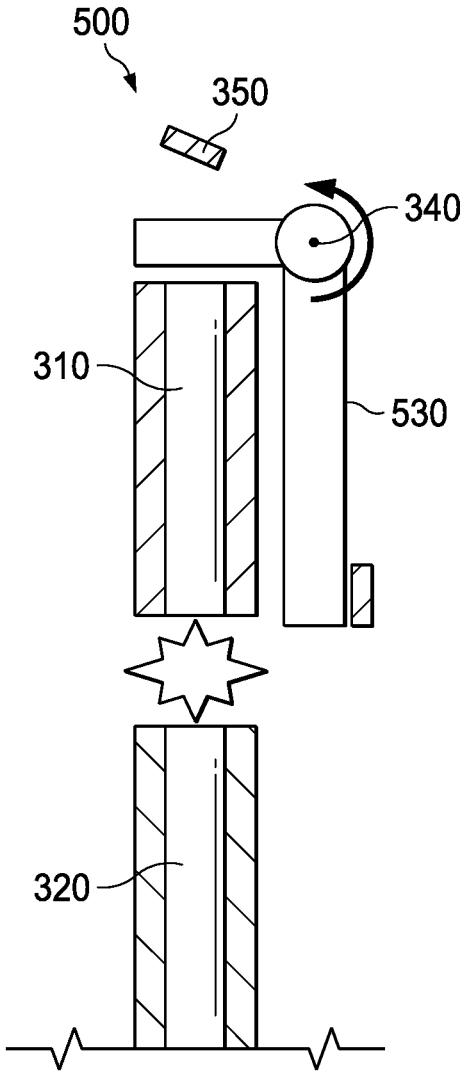

FIGS. 5A and 5B illustrate enlarged views of yet another detonation interrupt device 500 that is designed, manufactured, and/or operated according to one or more aspects of the disclosure. The detonation interrupt device 500 is similar in many respect to the detonation interrupt device 400 of FIGS. 4A and 4B. Accordingly, like reference numbers have been used to reference similar, if not identical, features. The detonation interrupt device 500 differs, for the most part, from the detonation interrupt device 400, in that the first detonation train member 310 is linearly misaligned with the second detonation train member 320 when the mechanical member 530 is in a first position, but the first detonation train member 310 is linearly aligned with the second detonation train member 320 when the mechanical member 530 is in the second position. Accordingly, by applying force 550 to the mechanical member 530, the first and second detonation train member 310, 320 can automatically go from linearly misaligned to linearly aligned.

Figure 6A:
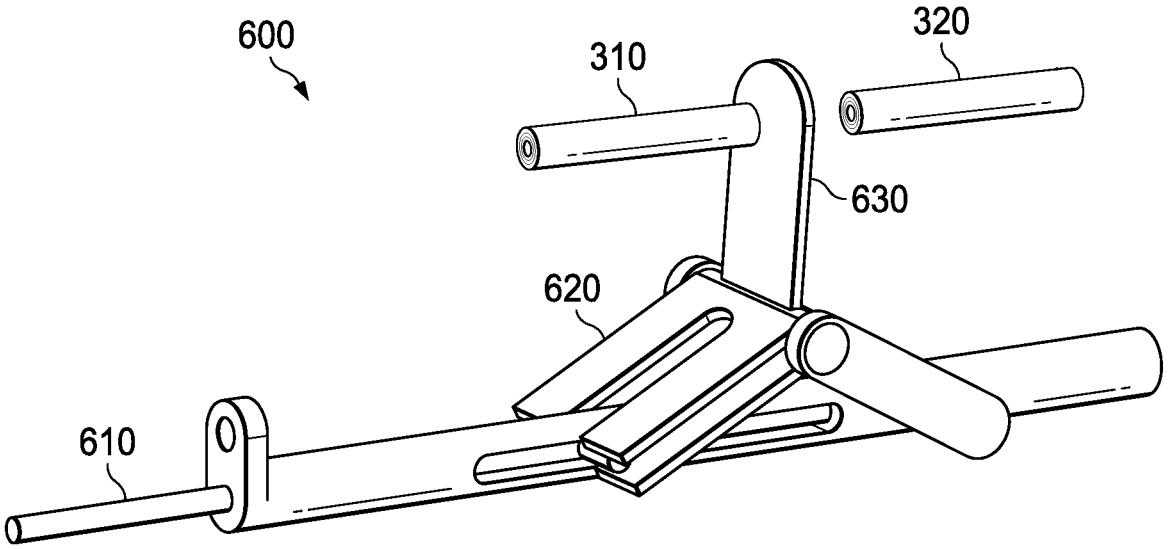
FIGS. 6A and 6B illustrate enlarged views of an alternative detonation interrupt device that is designed, manufactured, and/or operated according to one or more aspects of the disclosure.
Figure 6B:
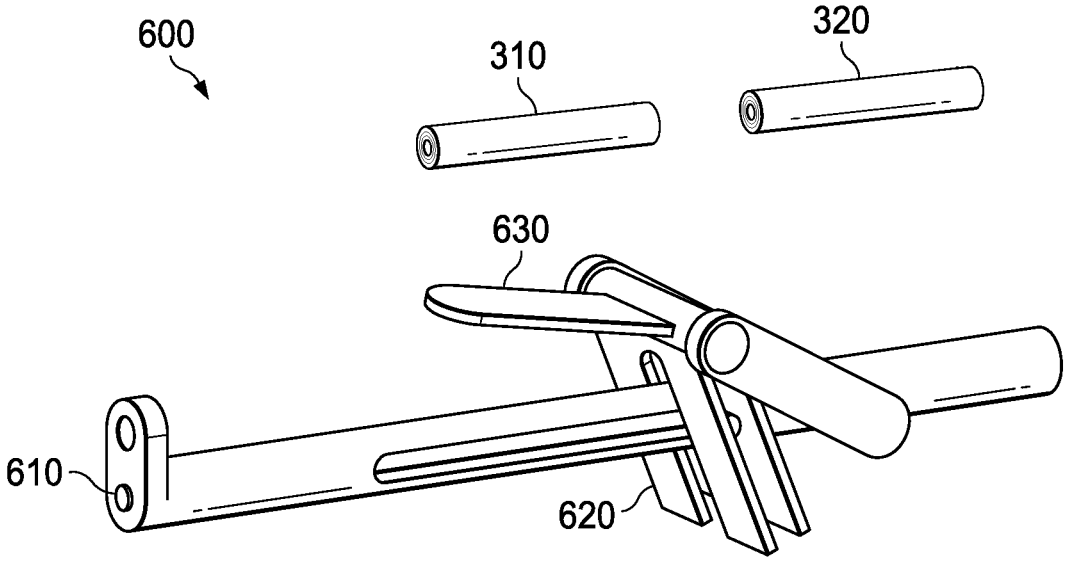

FIGS. 6A and 6B illustrate enlarged views of an alternative detonation interrupt device 600 that is designed, manufactured, and/or operated according to one or more aspects of the disclosure. The detonation interrupt device 600 is similar in certain respects to the detonation interrupt device 400 of FIGS. 4A and 4B. Accordingly, like reference numbers have been used to reference similar, if not identical, features. The detonation interrupt device 600 includes a rod 610 coupled to a pin-on-lever 620, which is coupled to the mechanical member 630. Accordingly, by pushing the rod 610, the pin-on-lever 620 moves the mechanical member 630 from the first position shown in FIG. 6A to the second position shown in FIG. 6B.

Figure 7A:
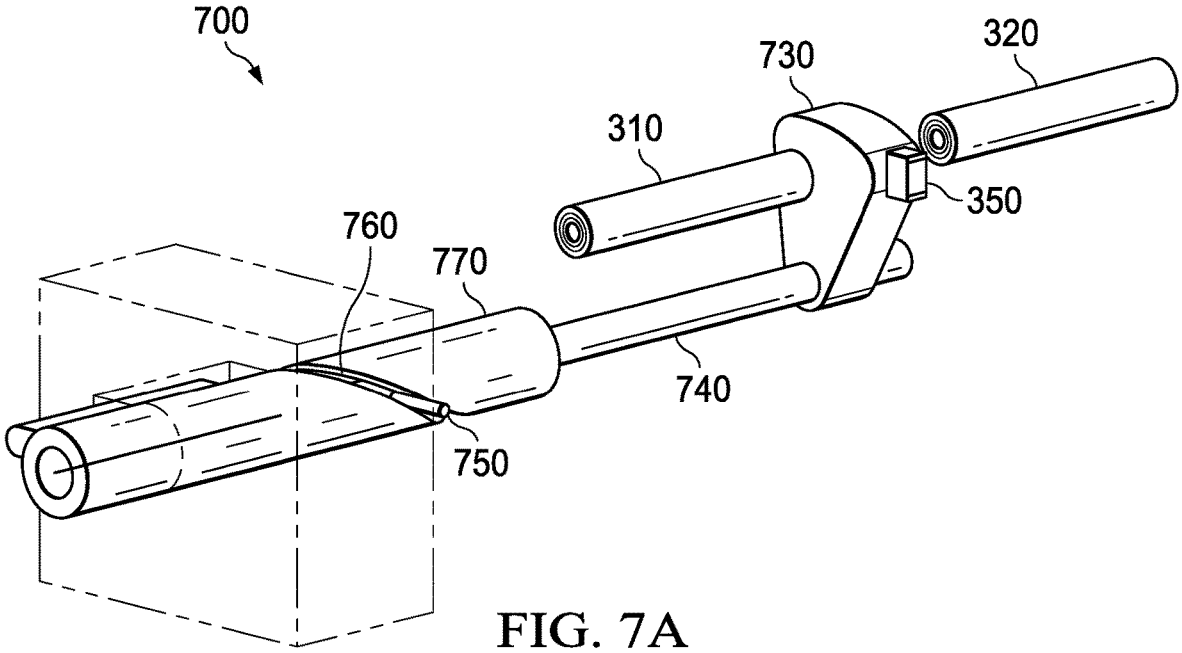
FIGS. 7A, 7B and 7C illustrate enlarged views of an alternative detonation interrupt device that is designed, manufactured, and/or operated according to one or more aspects of the disclosure.
Figure 7B:
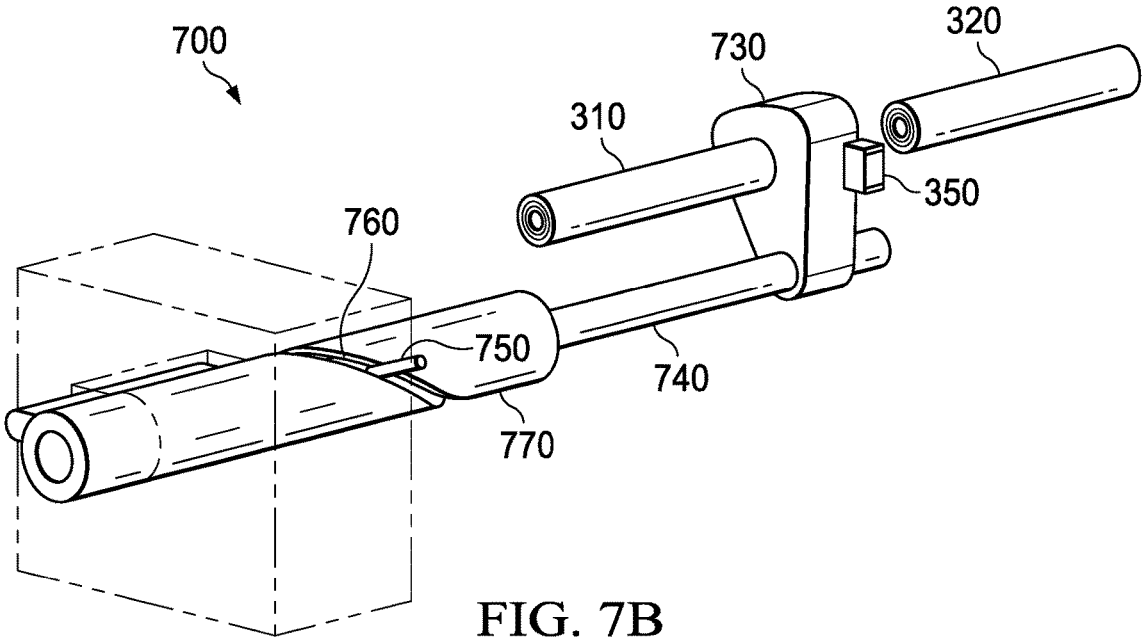
Figure 7C:
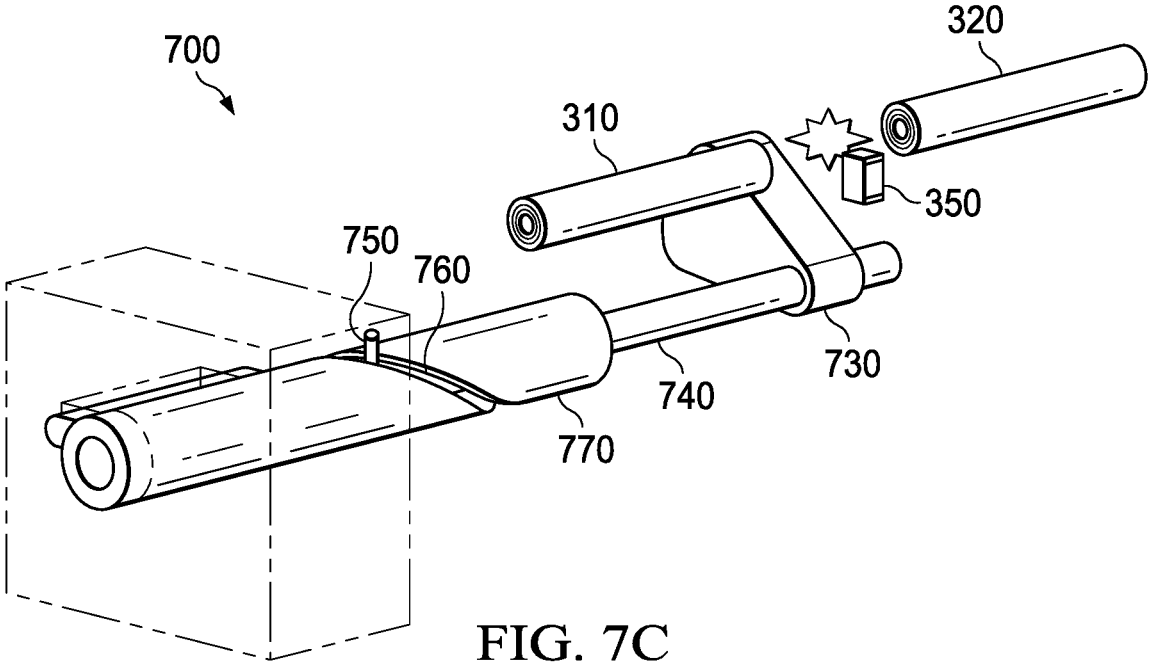

FIGS. 7A, 7B and 7C illustrate enlarged views of an alternative detonation interrupt device 700 that is designed, manufactured, and/or operated according to one or more aspects of the disclosure. The detonation interrupt device 700 is similar in certain respects to the detonation interrupt device 500 of FIGS. 5A and 5B. Accordingly, like reference numbers have been used to reference similar, if not identical, features. The detonation interrupt device 700, in contrast to that of FIGS. 5A and 5B, employs a mechanical member 730 that rotates about an axis that is substantially parallel to a direction of movement of the housing. FIG. 7A illustrates the mechanical member 730 physically separating the first detonation train member 310 and the second detonation train member 320, as well as the electronic disconnect member 350 decoupling the first detonation train member 310 from associated detonation electronics. FIG. 7B illustrates the mechanical member 730 physically separating the first detonation train member 310 and the second detonation train member 320, but the first detonation train member 310 is electrically coupled with the detonation electronics. FIG. 7C illustrates the mechanical member 730 not physically separating the first detonation train member 310 and the second detonation train member 320, and the first detonation train member 310 electrically coupled with the detonation electronics.

In the illustrated embodiment of FIGS. 7A, 7B, and 7C, the mechanical member 730 includes a rod 740 having a pin 750 associated therewith. In this embodiment, the pin 750 slides within a spiral slot 760 in a linearly moving sleeve 770. Nevertheless, in certain other embodiments, as opposed to the pin 750 and spiral slot 760, a boss or other combination of features may be used to create the motion (e.g., a gear system, such as a rack and pinion or worm gear). Accordingly, as a force is applied to the linearly moving sleeve 770, the pin 750 slides within the spiral slot 760 and thereby rotates the rod 740 and attached mechanical member 730, thereby moving the mechanical member 730 from the first position shown in FIG. 7A, through the intermediate position shown in FIG. 7B, and to the second position shown in FIG. 7C.

Figure 8A:
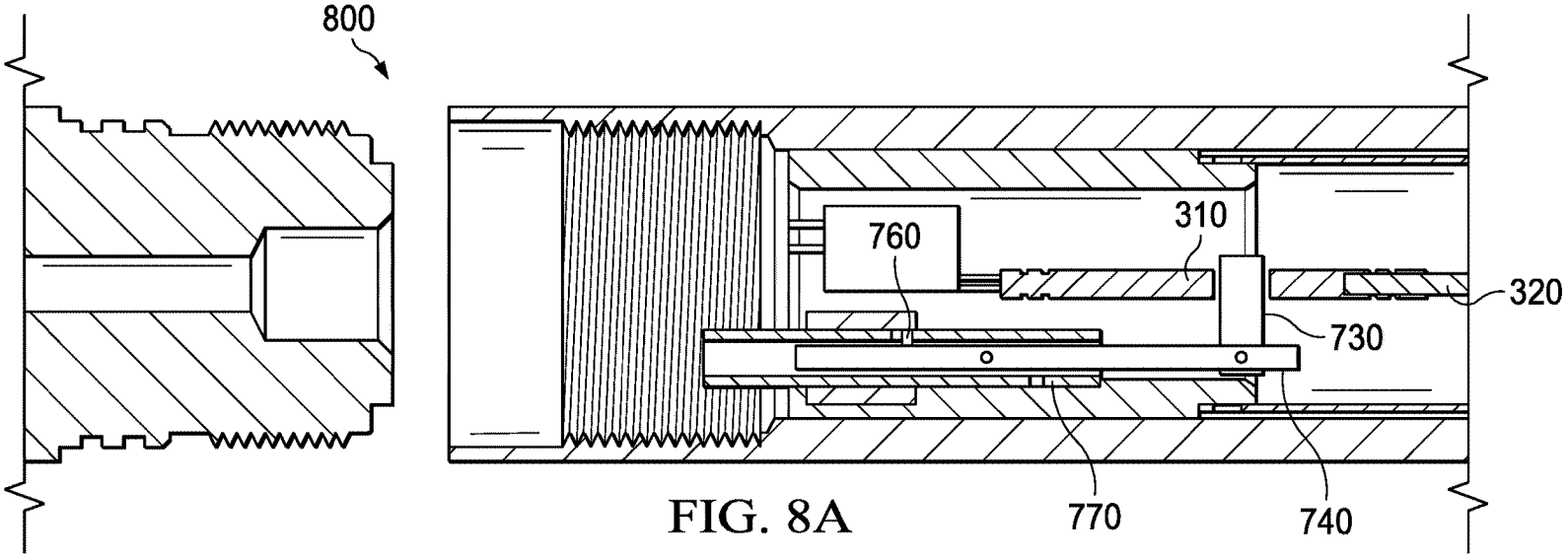
FIGS. 8A and 8B illustrate enlarged views of an alternative perforating gun assembly that is designed, manufactured, and/or operated according to one or more aspects of the disclosure.
Figure 8B:
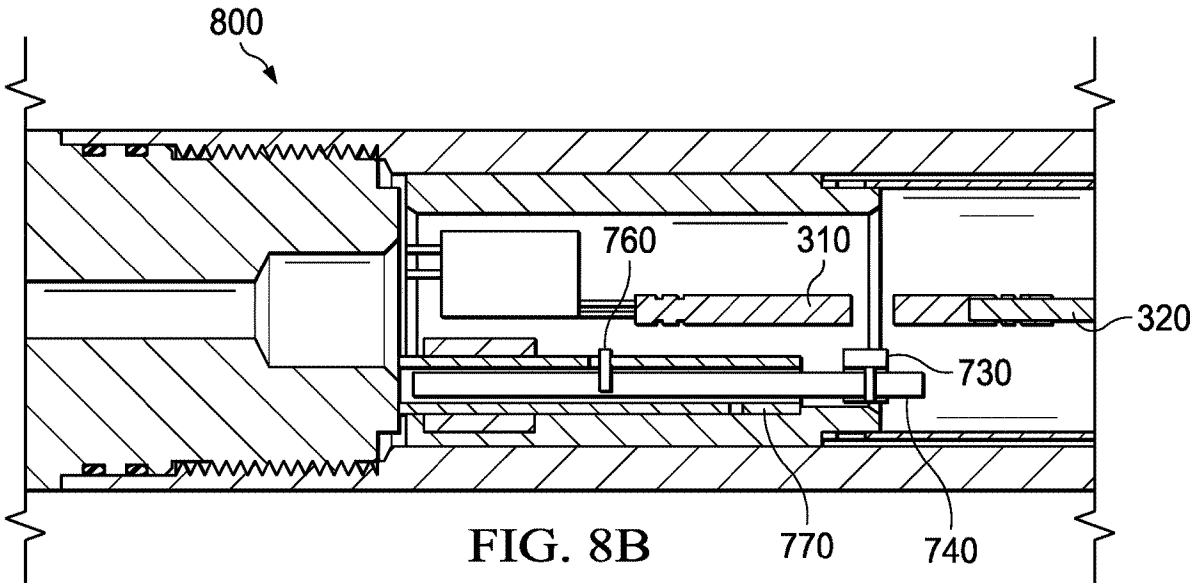

FIGS. 8A and 8B illustrate enlarged views of an alternative perforating gun assembly 800 that is designed, manufactured, and/or operated according to one or more aspects of the disclosure. The perforating gun assembly 800, in the illustrated embodiment, employs the detonation interrupt device 700 illustrated in FIGS. 7A, 7B, and 7C. Accordingly, FIGS. 8A and 8B illustrate how multiple housings may be brought together to apply a force to the linearly moving sleeve 770 to move the mechanical member 730 from the first position to the second position. Specifically, FIG. 8A illustrates the mechanical member 730 in the first position, and FIG. 8B illustrates the mechanical member 730 in the second position.

Aspects disclosed herein include:

A. A detonation interrupt device, the detonation interrupt device comprising: 1) a first detonation train member positioned within a housing, and 2) a mechanical member positioned proximate the first detonation train member, the mechanical member movable between a first position physically separating the first detonation train member from a second detonation train member and thereby preventing the first detonation train member from detonating the second detonation train member, and a second position not physically separating the first detonation train member from the second detonation train member and thereby allowing the first detonation train member to detonate the second detonation train member, wherein the mechanical member is configured to automatically move from the first position to the second position as the housing and the second detonation train member move linearly with respect to each other.

B. A perforating gun assembly for use in a wellbore, the perforating gun assembly comprising: 1) a carrier gun body; 2) one or more ballistic elements supported within the carrier gun body; 3) a detonation cord extending through the carrier gun body to the one or more ballistic elements; and 4) a detonation interrupt device, the detonation interrupt device including; a) a detonation train member positioned within a housing coupled to the carrier gun body; and b) a mechanical member positioned proximate the detonation train member, the mechanical member movable between a first position physically separating the detonation train member from the detonation cord and thereby preventing the detonation train member from detonating the detonation cord, and a second position not physically separating the detonation train member from the detonation cord and thereby allowing the detonation train member to detonate the detonation cord, wherein the mechanical member is configured to automatically move from the first position to the second position as the housing and the second detonation train member move linearly with respect to each other.

C. A well system, the well system comprising: 1) a wellbore; and 2) a perforating gun assembly positioned within the wellbore, the perforating gun assembly held in place by a conveyance and including: a) a carrier gun body; b) one or more ballistic elements supported within the carrier gun body; c) a detonation cord extending through the carrier gun body to the one or more ballistic elements; and d) a detonation interrupt device, the detonation interrupt device including; i) a detonation train member positioned within a housing coupled to the carrier gun body; and ii) a mechanical member positioned proximate the detonation train member, the mechanical member movable between a first position physically separating the detonation train member from the detonation cord and thereby preventing the detonation train member from detonating the detonation cord, and a second position not physically separating the detonation train member from the detonation cord and thereby allowing the detonation train member to detonate the detonation cord, wherein the mechanical member is configured to automatically move from the first position to the second position as the housing and the second detonation train member move linearly with respect to each other.

Aspects A, B, and C may have one or more of the following additional elements in combination: Element 1: wherein the first detonation train member is a detonator and the second detonation train member is a detonation cord. Element 2: wherein the first detonation train member is a first detonation cord associated with a first gun set and the second detonation train member is a second detonation cord associated with a second gun set. Element 3: wherein the mechanical member is configured to automatically move from the first position to the second position as the housing linearly moves toward the second detonation train member. Element 4: wherein the mechanical member is configured to automatically move from the first position to the second position as the housing and the first detonation train member linearly move toward the second detonation train member. Element 5: wherein the mechanical member is configured to rotate about an axis that is substantially perpendicular to a direction of movement of the housing. Element 6: wherein an outer sloped surface of the mechanical member is configured to engage with and slide along a surface of the second detonation train member as the housing moves toward the second detonation train member to rotate the mechanical member from the first position to the second position. Element 7: wherein the first detonation train member and the second detonation train member are configured to linearly move toward one another as the mechanical member rotates from the first position to the second position. Element 8: wherein a force applied upon the mechanical member generated by the movement of the housing is configured to rotate the mechanical member from the first position to the second position. Element 9: wherein the first detonation train member and the second detonation train member are configured to be linearly fixed relative to one another as the mechanical member rotates from the first position to the second position. Element 10: wherein the force applied upon the mechanical member is configured to rotate the first detonation train member from a first position linearly misaligned with the second detonation train member to a second position linearly aligned with the second detonation train member. Element 11: wherein the mechanical member is configured to rotate about an axis that is substantially parallel to a direction of movement of the housing. Element 12: wherein the mechanical member includes a rod having a pin associated therewith, the pin configured to slide within a spiral slot in a linearly moving sleeve to rotate the mechanical member about the axis that is substantially parallel to the direction of movement of the housing. Element 13: further including an electronic disconnect member configured to electrically disarm the first detonation train member when the mechanical member is in the first position and electrically arm the first detonation train member when the mechanical member is in the second position. Element 14: wherein the electronic disconnect member is an electric shunt that electrically decouples the first detonation train member from detonation electronics when the mechanical member is in the first position and electrically couples the first detonation train member from the detonation electronics when the mechanical member is in the second position. Element 15: wherein the housing is a detonator alignment housing and the detonation train member is a detonator, and further wherein the first position physically separates the detonator from the detonation cord and thereby prevents the detonator from detonating the detonation cord, and the second position does not physically separate the detonator from the detonation cord and thereby allows the detonator to detonate the second detonation train member. Element 16: wherein the carrier gun body is a downhole carrier gun body having a plurality of downhole ballistic elements supported therein and a downhole detonation cord extending there through, and further wherein the housing is a gun connector housing and the detonation train member is an uphole detonation cord from an uphole carrier gun body having a plurality of uphole ballistic elements supported therein, and further wherein the first position physically separates the uphole detonation cord from the downhole detonation cord and thereby prevents the uphole detonation cord from detonating the downhole detonation cord, and the second position does not physically separate the uphole detonation cord from the downhole detonation cord and thereby allows the uphole detonation cord to detonate the downhole detonation cord. Element 17: further including an electronic disconnect member configured to electrically disarm the detonation train member when the mechanical member is in the first position and electrically arm the detonation train member when the mechanical member is in the second position.

Those skilled in the art to which this application relates will appreciate that other and further additions, deletions, substitutions and modifications may be made to the described embodiments.

What is claimed is:

1. A detonation interrupt device, comprising:

a first detonation train member positioned within a housing; and a mechanical member positioned proximate the first detonation train member, the mechanical member movable between a first position physically separating the first detonation train member from a second detonation train member and thereby preventing the first detonation train member from detonating the second detonation train member, and a second position not physically separating the first detonation train member from the second detonation train member and thereby allowing the first detonation train member to detonate the second detonation train member, wherein the mechanical member is configured to automatically move from the first position to the second position as the housing and the second detonation train member move linearly with respect to each other, wherein the first detonation train member is a detonator and the second detonation train member is a detonation cord, or the first detonation train member is a first detonation cord associated with a first gun set and the second detonation train member is a second detonation cord associated with a second gun set.

2. The detonation interrupt device as recited in claim 1, wherein the mechanical member is configured to automatically move from the first position to the second position as the housing linearly moves toward the second detonation train member.

3. The detonation interrupt device as recited in claim 2, wherein the mechanical member is configured to automatically move from the first position to the second position as the housing and the first detonation train member linearly move toward the second detonation train member.

4. The detonation interrupt device as recited in claim 2, wherein the mechanical member is configured to rotate about an axis that is substantially perpendicular to a direction of movement of the housing.

5. The detonation interrupt device a recited in claim 4, wherein an outer sloped surface of the mechanical member is configured to engage with and slide along a surface of the second detonation train member as the housing moves toward the second detonation train member to rotate the mechanical member from the first position to the second position.

6. The detonation interrupt device as recited in claim 5, wherein the first detonation train member and the second detonation train member are configured to linearly move toward one another as the mechanical member rotates from the first position to the second position.

7. The detonation interrupt device as recited in claim 4, wherein a force applied upon the mechanical member generated by the movement of the housing is configured to rotate the mechanical member from the first position to the second position.

8. The detonation interrupt device as recited in claim 7, wherein the first detonation train member and the second detonation train member are configured to be linearly fixed relative to one another as the mechanical member rotates from the first position to the second position.

9. The detonation interrupt device as recited in claim 8, wherein the force applied upon the mechanical member is configured to rotate the first detonation train member from a first position linearly misaligned with the second detonation train member to a second position linearly aligned with the second detonation train member.

10. The detonation interrupt device as recited in claim 2, wherein the mechanical member is configured to rotate about an axis that is substantially parallel to a direction of movement of the housing.

11. The detonation interrupt devices as recited in claim 10, wherein the mechanical member includes a rod having a pin associated therewith, the pin configured to slide within a spiral slot in a linearly moving sleeve to rotate the mechanical member about the axis that is substantially parallel to the direction of movement of the housing.

12. The detonation interrupt device as recited in claim 1, further including an electronic disconnect member configured to electrically disarm the first detonation train member when the mechanical member is in the first position and electrically arm the first detonation train member when the mechanical member is in the second position.

13. The detonation interrupt device as recited in claim 12, wherein the electronic disconnect member is an electric shunt that electrically decouples the first detonation train member from detonation electronics when the mechanical member is in the first position and electrically couples the first detonation train member from the detonation electronics when the mechanical member is in the second position.

14. A perforating gun assembly for use in a wellbore, the perforating gun assembly comprising:

a carrier gun body;

one or more ballistic elements supported within the carrier gun body;

a detonation cord extending through the carrier gun body to the one or more ballistic elements; and a detonation interrupt device, the detonation interrupt device including;

a detonation train member positioned within a housing coupled to the carrier gun body; and a mechanical member positioned proximate the detonation train member, the mechanical member movable between a first position physically separating the detonation train member from the detonation cord and thereby preventing the detonation train member from detonating the detonation cord, and a second position not physically separating the detonation train member from the detonation cord and thereby allowing the detonation train member to detonate the detonation cord, wherein the mechanical member is configured to automatically move from the first position to the second position as the housing and the second detonation train member move linearly with respect to each other.

15. The perforating gun assembly as recited in claim 14, wherein the housing is a detonator alignment housing and the detonation train member is a detonator, and further wherein the first position physically separates the detonator from the detonation cord and thereby prevents the detonator from detonating the detonation cord, and the second position does not physically separate the detonator from the detonation cord and thereby allows the detonator to detonate the second detonation train member.

16. The perforating gun assembly as recited in claim 14, wherein the carrier gun body is a downhole carrier gun body having a plurality of downhole ballistic elements supported therein and a downhole detonation cord extending there through, and further wherein the housing is a gun connector housing and the detonation train member is an uphole detonation cord from an uphole carrier gun body having a plurality of uphole ballistic elements supported therein, and further wherein the first position physically separates the uphole detonation cord from the downhole detonation cord and thereby prevents the uphole detonation cord from detonating the downhole detonation cord, and the second position does not physically separate the uphole detonation cord from the downhole detonation cord and thereby allows the uphole detonation cord to detonate the downhole detonation cord.

17. The perforating gun assembly as recited in claim 14, further including an electronic disconnect member configured to electrically disarm the detonation train member when the mechanical member is in the first position and electrically arm the detonation train member when the mechanical member is in the second position.

18. A well system, comprising:

a wellbore; and a perforating gun assembly positioned within the wellbore, the perforating gun assembly held in place by a conveyance and including:

a carrier gun body;

one or more ballistic elements supported within the carrier gun body;

a detonation cord extending through the carrier gun body to the one or more ballistic elements; and a detonation interrupt device, the detonation interrupt device including;

a detonation train member positioned within a housing coupled to the carrier gun body; and a mechanical member positioned proximate the detonation train member, the mechanical member movable between a first position physically separating the detonation train member from the detonation cord and thereby preventing the detonation train member from detonating the detonation cord, and a second position not physically separating the detonation train member from the detonation cord and thereby allowing the detonation train member to detonate the detonation cord, wherein the mechanical member is configured to automatically move from the first position to the second position as the housing and the second detonation train member move linearly with respect to each other.

* * * * *